US007081002B2

(12) United States Patent
de Vanssay et al.

(10) Patent No.: US 7,081,002 B2
(45) Date of Patent: Jul. 25, 2006

(54) LOCKING DEVICE FOR A PLUG CONNECTION

(75) Inventors: Jean-Merri de Vanssay, Paris (FR); Jean Francois Bernat, Sartrouville (FR)

(73) Assignee: Harting Electronics GmbH & Co. KG (DE)

( * ) Notice: Subject to any disclaimer, the term of this patent is extended or adjusted under 35 U.S.C. 154(b) by 0 days.

(21) Appl. No.: 11/215,287

(22) Filed: Aug. 30, 2005

(65) Prior Publication Data

US 2006/0063415 A1 Mar. 23, 2006

(30) Foreign Application Priority Data

Sep. 23, 2004 (DE) ..... 10 2004 259

(51) Int. Cl.
*H01R 13/627* (2006.01)

(52) U.S. Cl. ..... 439/350; 439/358

(58) Field of Classification Search ..... 439/350, 439/358, 610

See application file for complete search history.

(56) References Cited

U.S. PATENT DOCUMENTS 4,838,808 A * 6/1989 Fujiura ..... 439/357
5,197,901 A * 3/1993 Hashiguchi ..... 439/352
5,580,268 A * 12/1996 Miyazawa ..... 439/352
5,634,809 A 6/1997 Hirai ..... 439/352
6,231,392 B1 * 5/2001 van Woensel ..... 439/610
6,705,897 B1 * 3/2004 Chen et al. ..... 439/610
6,799,986 B1 * 10/2004 Igarashi et al. ..... 439/358

FOREIGN PATENT DOCUMENTS

| | | |
|---|---|---|
| DE | 102 36 275 | 1/2004 |
| EP | 0 562 311 | 6/1997 |
| EP | 1 453 148 | 9/2004 |

* cited by examiner

*Primary Examiner*—Tho D. Ta
(74) *Attorney, Agent, or Firm*—Hayes Soloway P.C.

(57) ABSTRACT

The invention pertains to a separable plug connection, particularly for rectangular connectors that are composed of a shielding metal housing, a connector insert and an insulating sleeve that encompasses the metal housing, as well as a correspondingly designed mating connector. The invention proposes to arrange the encompassing sleeve in a displaceable fashion, wherein metal locking levers arranged on the metal housing are guided into a slot within the sleeve in such a way that the free ends of the metal locking levers are pressed part during a sliding movement of the sleeve. When the connector and the corresponding mating connector are connected and interlocked, this causes hooks integrally arranged on the metal locking levers to be levered out of opening arranged on the mating connector such that the locking device is released. The hooks engage into the openings when the plug connection needs to be interlocked.

21 Claims, 7 Drawing Sheets

LOCKING DEVICE FOR A PLUG CONNECTION

FIELD OF THE INVENTION

The invention pertains to a locking device for a separable plug connection, particularly for rectangular connectors that are composed of a shielding metal housing, a connector insert and an insulating sleeve that encompasses the metal housing, as well as a correspondingly designed mating connector.

BACKGROUND OF THE INVENTION

A locking device of this type is required for locking a separable plug connection consisting of a plug connector and a mating connector and to separate said connection by means of a simple mechanism.

In the locking device disclosed in DE 102 36 275 B3, a sliding sleeve is provided on a plug housing with integral clips arranged thereon, wherein said clips engage into corresponding recesses in a mating connector and can be disengaged by displacing the sliding sleeve.

Known plug connectors of this type are frequently manufactured in the form of plastic parts and consequently not intended for frequent insertion/withdrawal cycles. In addition, the relatively low locking forces result in an insecurely interlocked connection.

SUMMARY OF THE INVENTION

Based on these circumstances, the invention aims to design a plug connection of the initially described type, in which a plug housing of rectangular shape that is immune to perturbing radiation can be interlocked with a mating connector by means of a sliding mechanism such that high mechanical locking forces and frequent insertion/withdrawal cycles can be achieved. This objective is attained in that the metal housing is divided into several parts, namely a housing base and a cover part, in that the cover part contains two metal locking levers with respective hooks integrally arranged thereon, in that the encompassing insulating sleeve contains slots in its lateral surfaces within the housing interior, and in that the metal locking levers of the metal housing are guided into the slots of the sleeve.

Plug connections of this type have a high wear resistance and provide a superior EMC protection due to their metallic sleeve.

The locking device for the plug connection is advantageously equipped with a sliding mechanism that makes it possible to easily lock and unlock the connection.

Metallic components need to be utilized in order to ensure approximately 5000 insertion/withdrawal cycles, as well as high locking forces on the order of 200 N. In addition, metallic components simultaneously make it possible to produce a clearly audible clicking sound when the plug connection is interlocked.

The plug connector is composed of a metal housing with a connector insert arranged therein and an end cap, wherein the connector is surrounded by a displaceable sleeve that is manufactured of an insulating material.

The metal housing consists of the interlocking parts of a housing base and a cover part.

It is advantageous that the sleeve can be displaced by a certain distance and is captively fixed on the metal housing.

The displaceable sleeve makes it possible to move two integral metal locking levers of the metal housing apart from one another such that hooks provided thereon are advantageously levered out of the corresponding openings in the mating connector and the interlocked plug connection is separated.

The metal locking levers are guided in slots arranged in the lateral surfaces in the interior of the sleeve. It is advantageous to arrange the slots at an angle that differs from the connecting direction such that a laterally yielding movement of the hooks on the ends of the metal locking levers can be achieved when the sleeve carries out a translatory movement. This ensures that the hooks are levered out of the corresponding openings in the mating connector.

The described plug connector is initially intended for a cable connection with a PCB edge connector that is also shielded from perturbing radiation by means of a metallic shroud.

However, this PCB edge connector can be easily replaced with a cable connector such that it is also possible to realize a genuine cable connection.

BRIEF DESCRIPTION OF THE DRAWINGS

One embodiment of the invention is illustrated in the figures and described in greater detail below. The figures show.

DETAILED DESCRIPTION OF THE INVENTION

Figure 1:
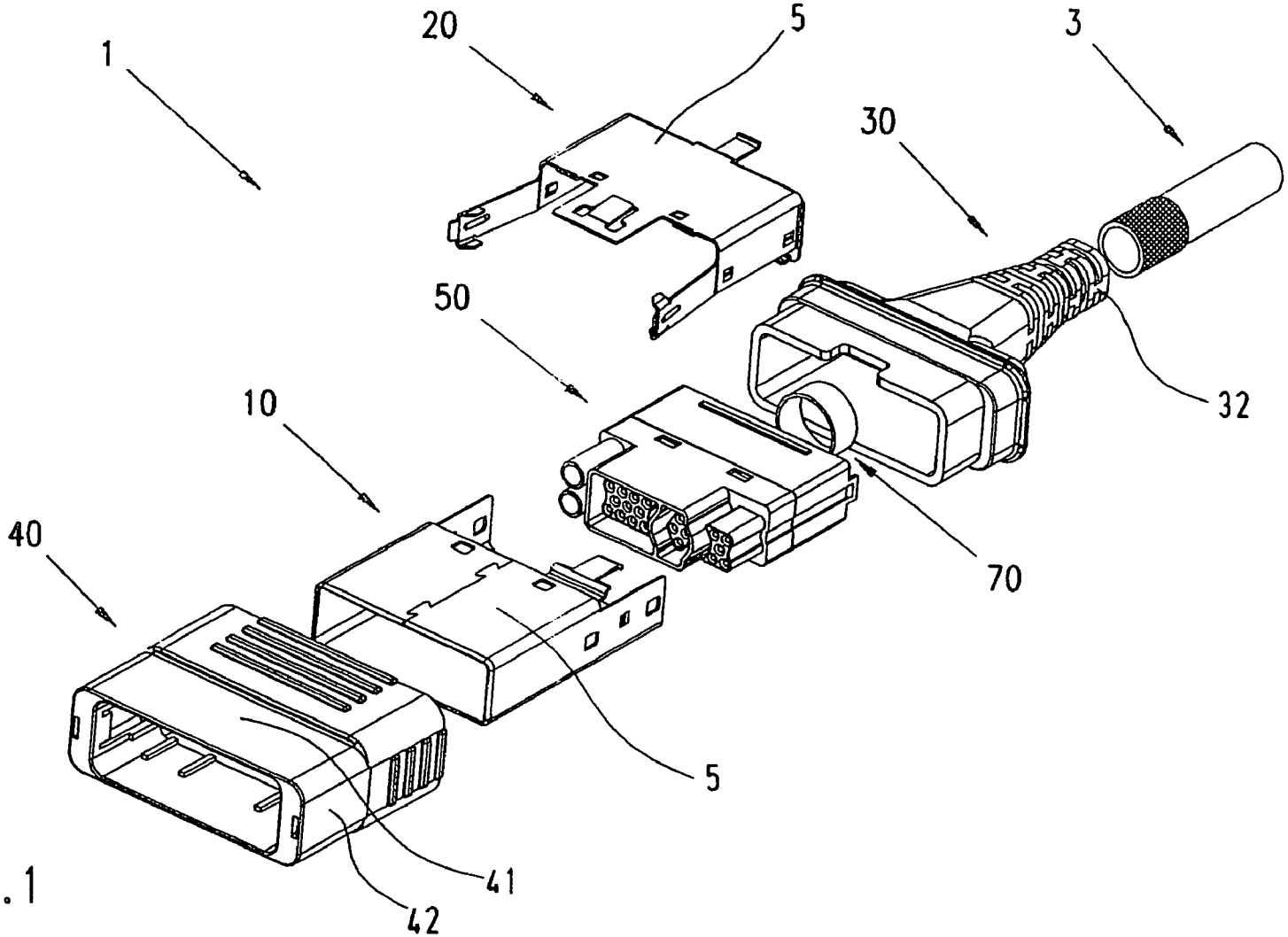
FIG. 1, an exploded view of a connector.

FIG. 1 shows an exploded view of a connector 1 consisting of a housing base 10 and a cover part 20 that form a metal housing 5 in the assembled state. A connector insert 50 that can be contacted with an electric cable 3 is arranged in this metal housing 5 and surrounded by a displaceable sleeve 40 of insulating material. An end cap 30 with a bend protection 32 of flexible insulating material is provided for holding the electric cable 3 and positively slipped on the metal housing 5.

Figure 2:
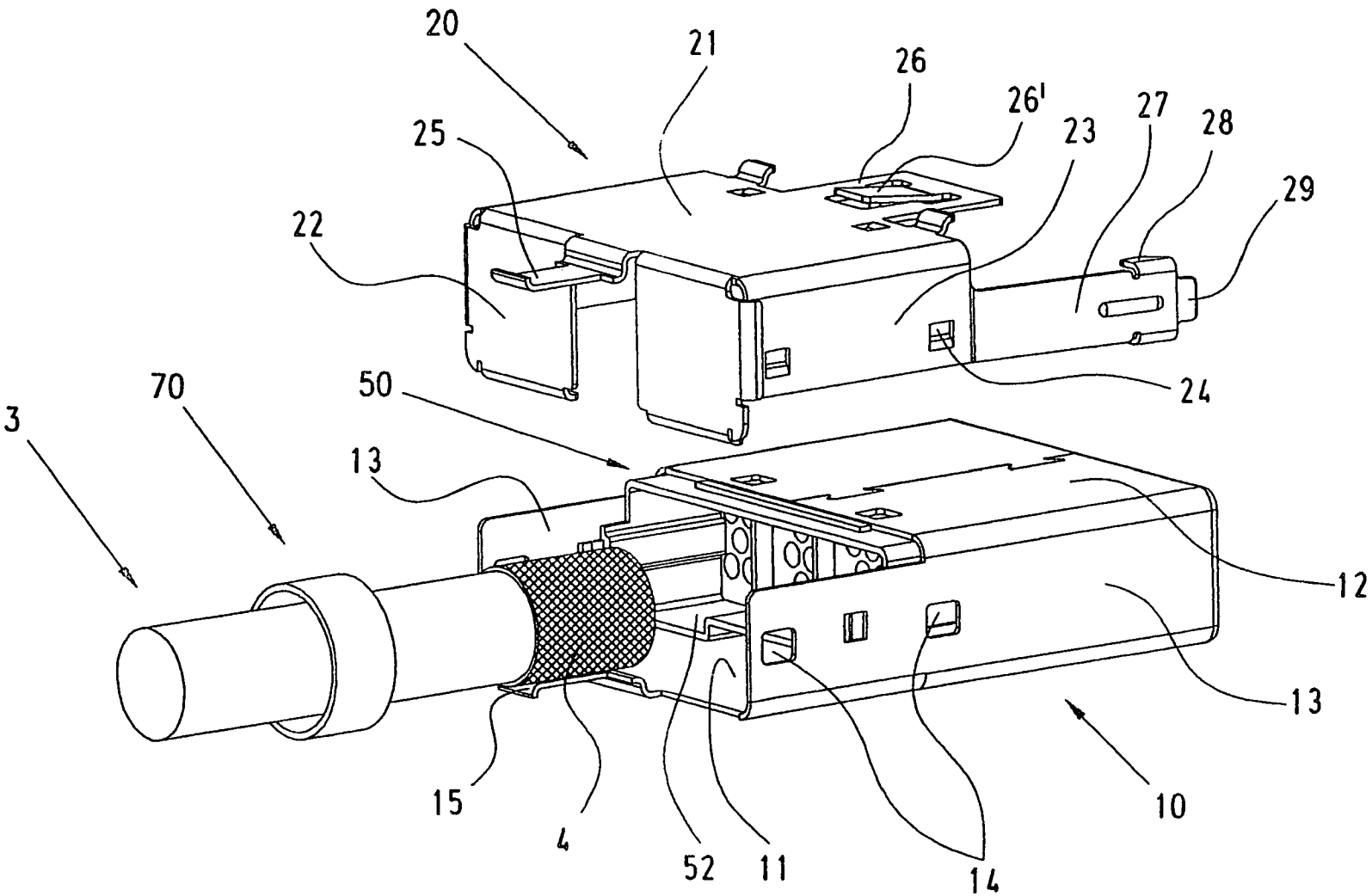
FIG. 2, an exploded view of the metal housing with the rear side of the connector.

The housing base 10 shown in FIG. 2 is realized in the form of a rectangular sleeve with a bottom surface 11, a top surface 12 and two narrow lateral surfaces 13, wherein the top surface 12 is shorter than the oppositely arranged bottom surface 11. The connector insert 50 is inserted into the thusly formed opening of the housing base.

When the connector insert 50 is correctly inserted and clipped into the housing base 10, the front side 51 is held within the metal housing 5 and the sleeve 40 while the rear side 52 is still arranged within the top surface 12.

Figure 3:
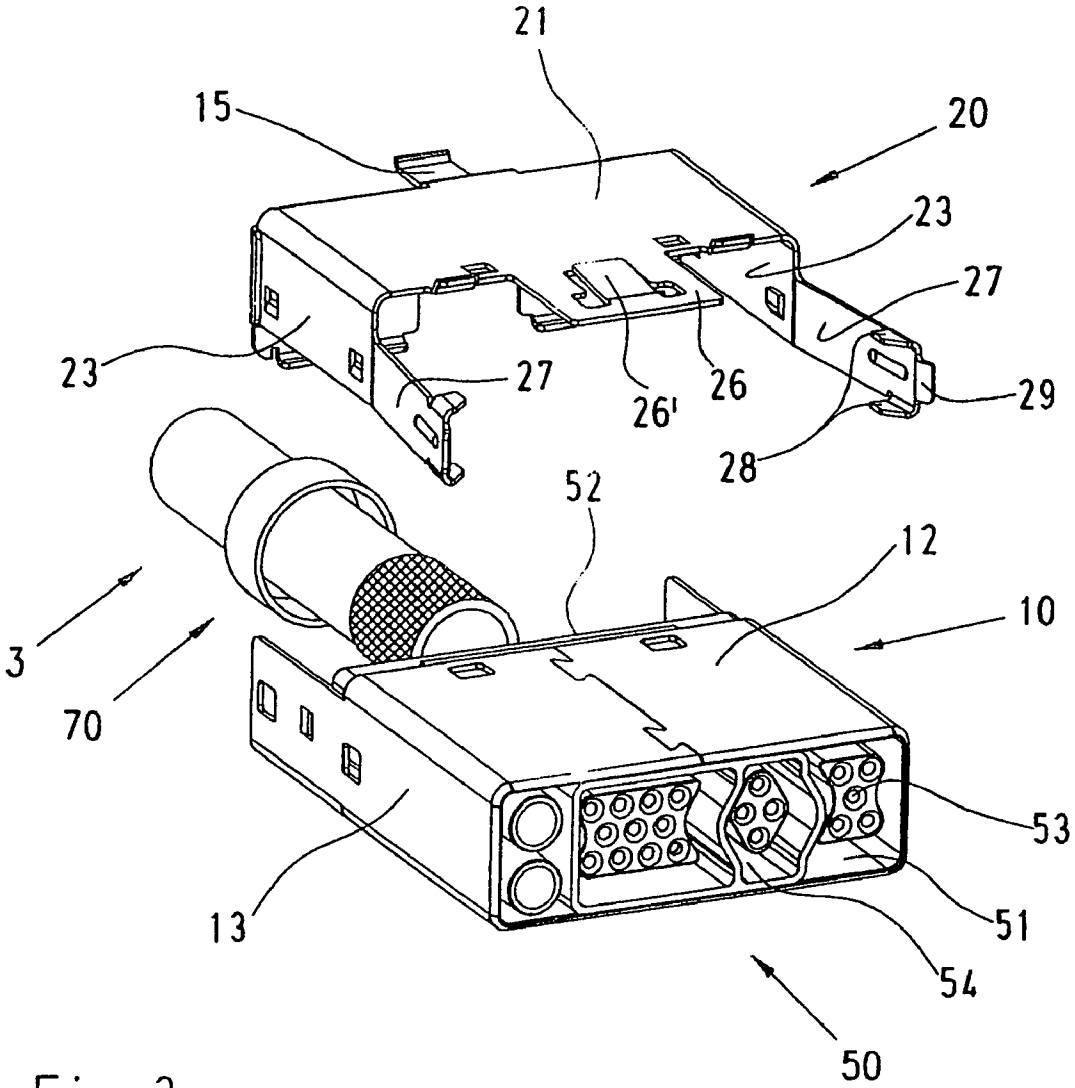
FIG. 3, an exploded view of the metal housing with the front side of the connector.

The connector insert 50 consists of insulating material, wherein the front side 51 contains female contacts 53 that are divided into data signal contacts and power supply contacts and inserted into differently shaped openings 54 in the connector insert (see FIG. 3).

This figure also indicates that the housing base 10 is preferably provided for realizing the shielding effect between the cable shield 4 and the front side while the cover part 20 is preferably designed for transmitting the mechanical retention forces. Various materials may be considered for this purpose.

The cover part 20 is attached and clipped on the open, freely accessible region of the housing base 10 that is situated behind the top surface 12 referred to the direction of the electric cable 3.

The cover part 20 is essentially bend in the shape of a U and comprises a top surface 21, two narrow lateral surfaces 23 and two angled rear walls 22 that form the rear end, wherein a central region remains open for the electric cable 3 to be contacted with the connector insert 50.

Metal locking levers 27 are integrally arranged on the lateral surfaces 23 of the cover part 20 such that they point in the connecting direction, wherein the ends of these metal locking levers contain hooks 28 as well as rounded ends 29 that are bent outward at a flat angle.

The cover part 20 and the housing base 10 contain clip elements 24, 14 in the form of tabs and corresponding openings that serve for clipping together the two housing parts.

In addition, a holding device 26 with a clip 26' realized freestanding on three sides is provided in the cover part 20 in the connecting direction in order to retain the sleeve 40 on the metal housing 5, namely such that the sleeve is captively held on the metal housing 5, but can still be displaced by a certain distance.

Tabs 15, 25 pointing toward the rear side are also provided on the metal housing 5, wherein the tab 25 integrally arranged on the cover part is positioned above the tab 15 integrally arranged on the housing base.

The electric cable 3 is arranged between these tabs with its cable braid 4 after the not-shown individual conductors are connected to the contacts in the connector insert. Subsequently, a crimp ring 70 that is already threaded on the electric cable 3 is pushed over the two tabs 15, 25 and this arrangement is crimped together with a crimping tool.

Figure 4:
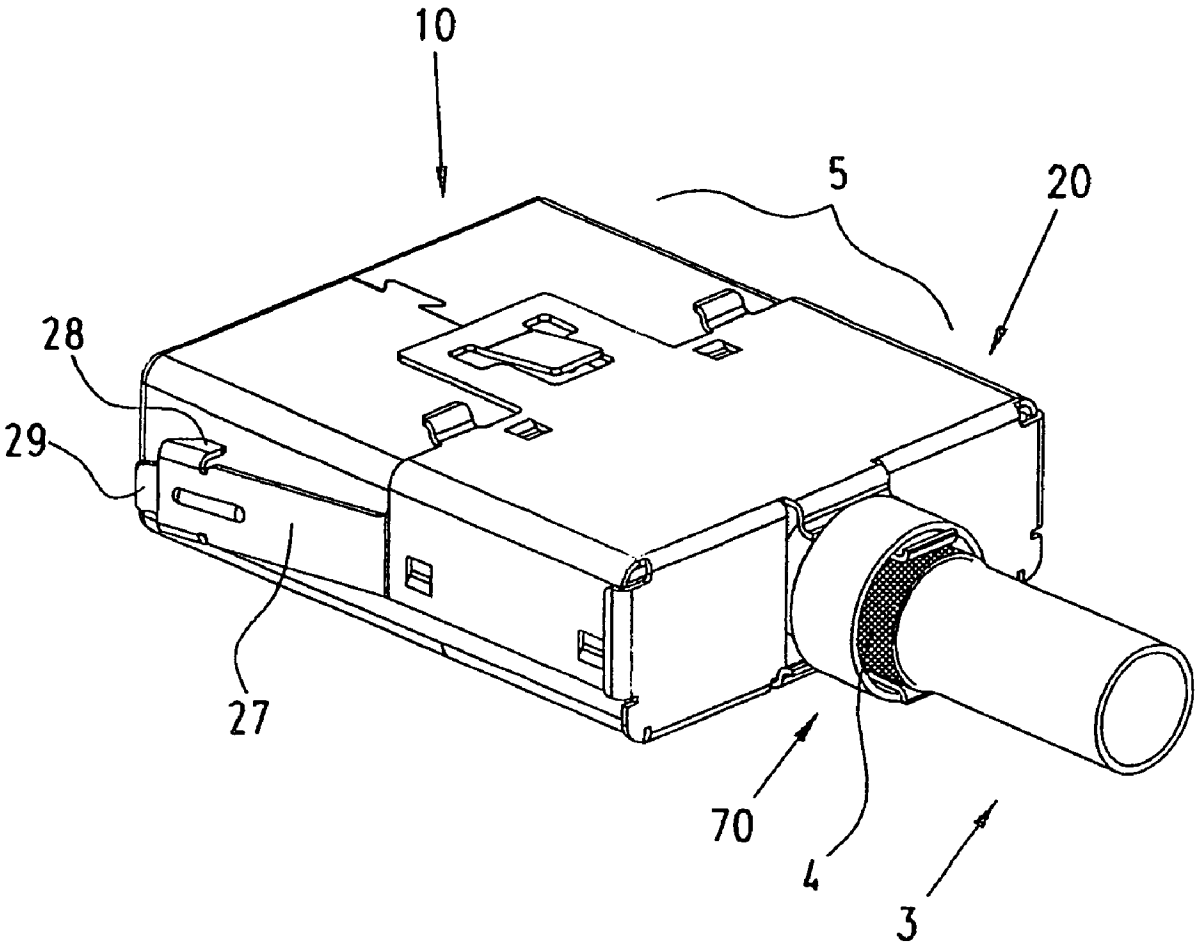
FIG. 4, an interlocked metal housing with the rear side of the connector.

FIG. 4 shows the metal housing 5 composed of the housing base 10 and the cover part 20, as well as a view of the rear side with the electric cable 3 and the yet to be crimped ring 70. This figure also shows the metal locking lever 27 that slightly protrudes from the side wall of the housing base 10, as well as the angled hook 28.

The sleeve 40 shown in FIG. 1 has a rectangular shape that matches the metal housing 5, wherein the narrow lateral surfaces 42 have, viewed from the front side, a regionally thicker wall than the two top surfaces 41.

Figure 5A:
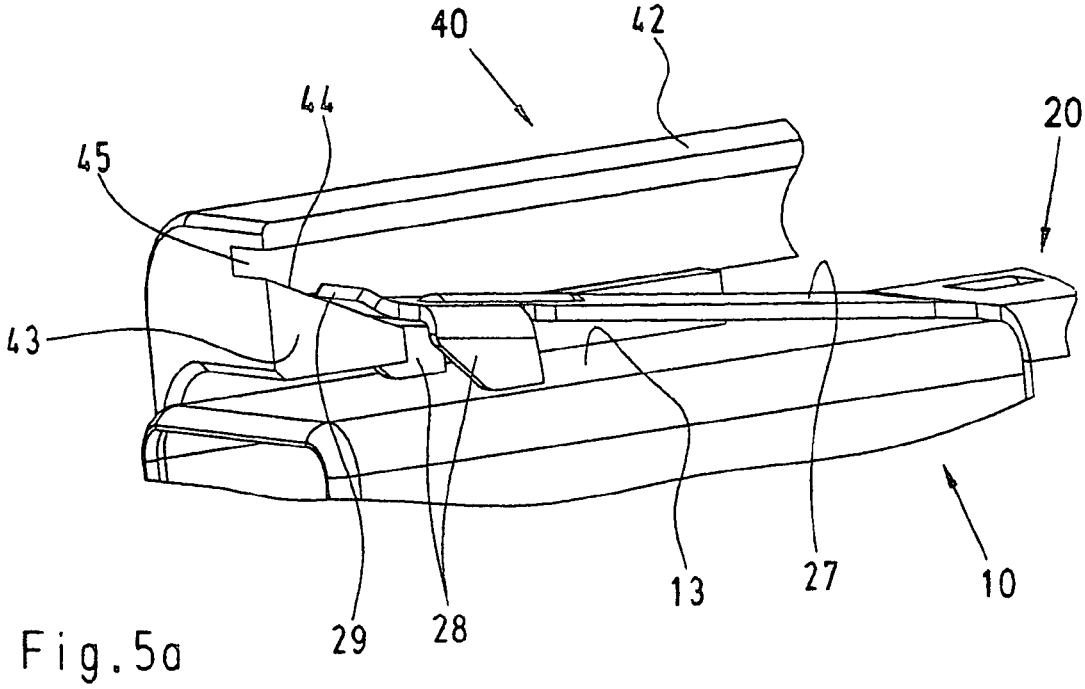
FIG. 5*a*, a partial section through the locking mechanism in the idle position.
Figure 5B:
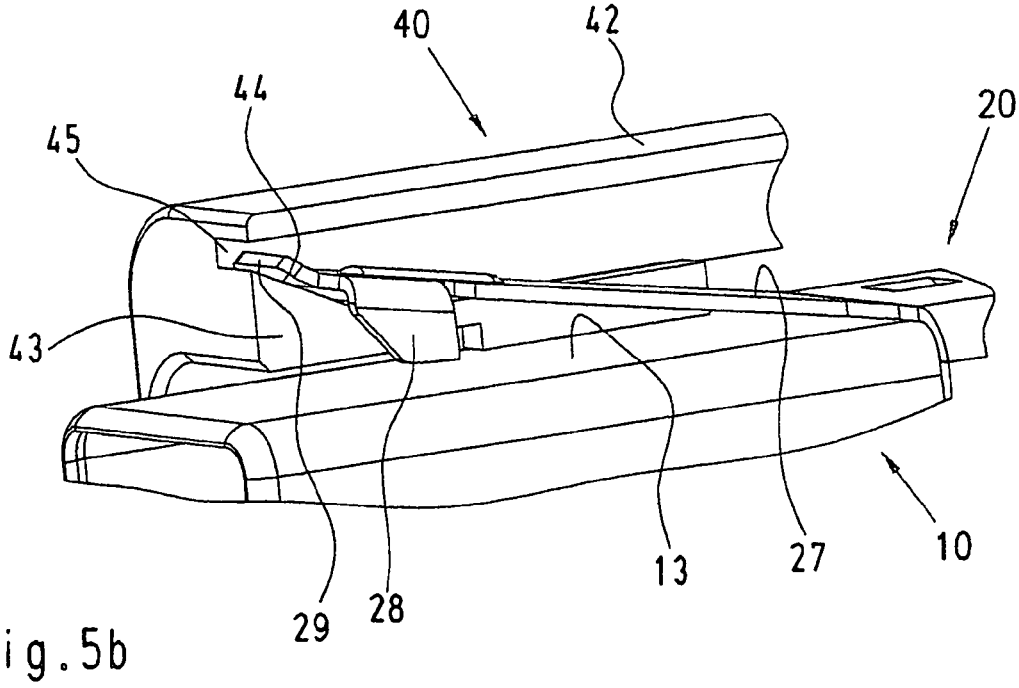
FIG. 5*b*, a partial section through the locking mechanism in the unlocked position.

FIGS. 5*a* and 5*b* show a detail that also elucidates other functions of the locking device.

A sloped tab 43 that is directed opposite to the connecting direction is integrally arranged within this at least regionally thicker wall of the lateral surface 42 and separated from the lateral surface 42 by a slot 45. A sliding surface 44 is provided on the sloped tab 43 in order to enable the end 29 of the metal locking lever 27 to slide along the sloped tab, wherein the tab 43 is realized in such a way that it is arranged between the hooks 28 that are integrally arranged on the end of the metal locking lever 27 on both sides. When the sleeve 40 is slipped on the metal housing 5 as shown in FIGS. 5*a* and 5*b*, the metal locking levers 27 are inevitably inserted into the slots 45 such that they are prestressed outward. This is achieved by slightly bending the end 29 of the metal locking lever outward directly adjacent to the twin hooks 28 such that the end 29 is threaded into the slots 45 that are inclined relative to the housing axis.

The metal locking levers are increasingly pulled apart as the sleeve is pushed rearward—opposite to the connecting direction. The metal locking lever protrudes from the side wall by an angle of approximately 250 in the idle state. However, an angle of approximately 300 is required in order to unlock the connection.

FIG. 5*a* shows the "idle state" in which the connector 1 is in its idle position or, in this case, the "interlocking position" with the mating connector 60. The hooks 28 of the connector 1 engage into openings 67 in the mating connector 60 and prevent the plug connection from unintentionally separating.

Figure 7:
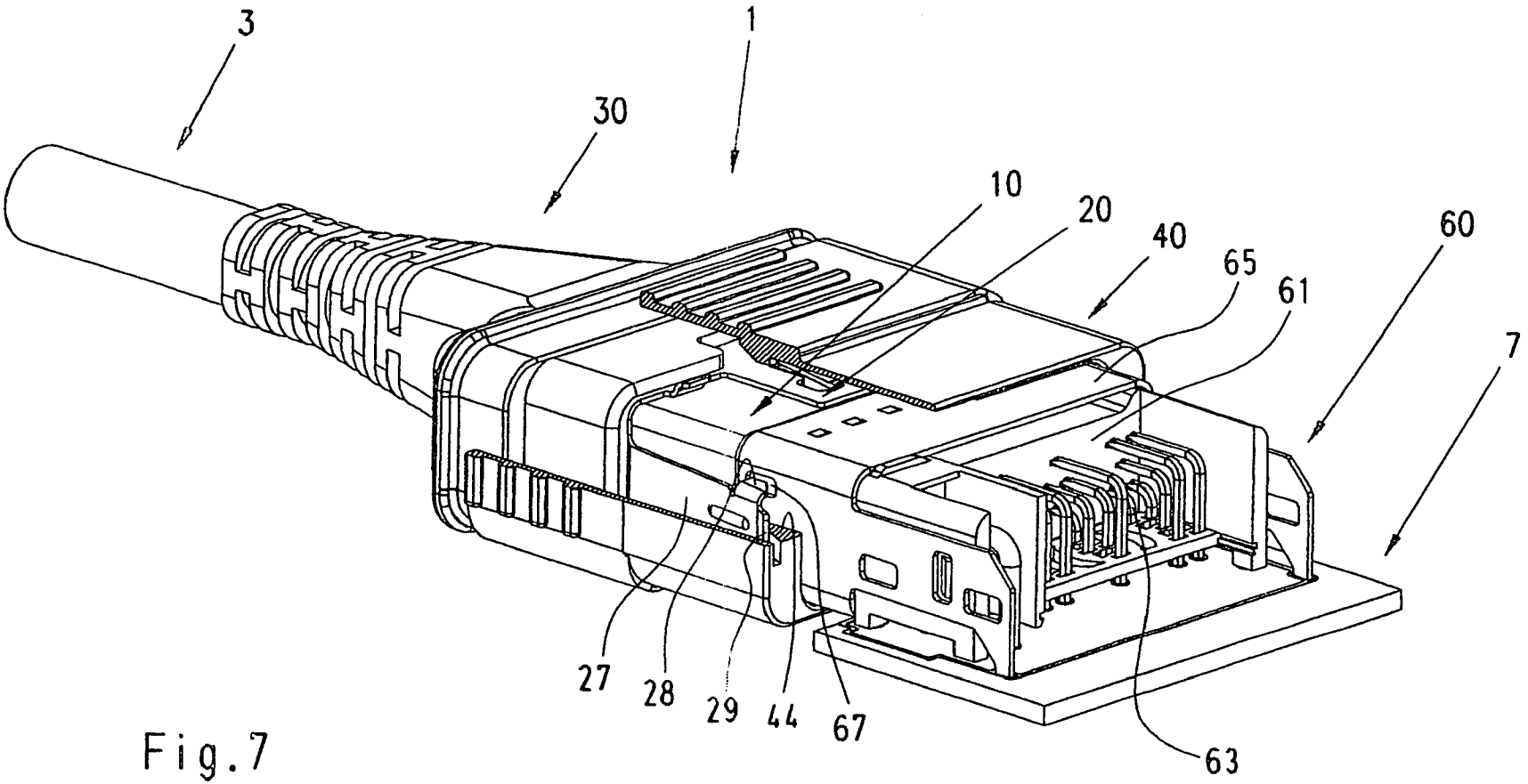

FIG. 5*b* shows the connector 1 with the sleeve 40 pulled back into the "unlocking position," wherein the metal housing protrudes from the sleeve by approximately 2 mm and the end 29 of the metal locking lever 27 simultaneously protrudes far into the slot 45 while the hooks 28 are already disengaged from the openings 67 such that the plug connection can be separated (in this respect, see also FIG. 7).

Figure 6:
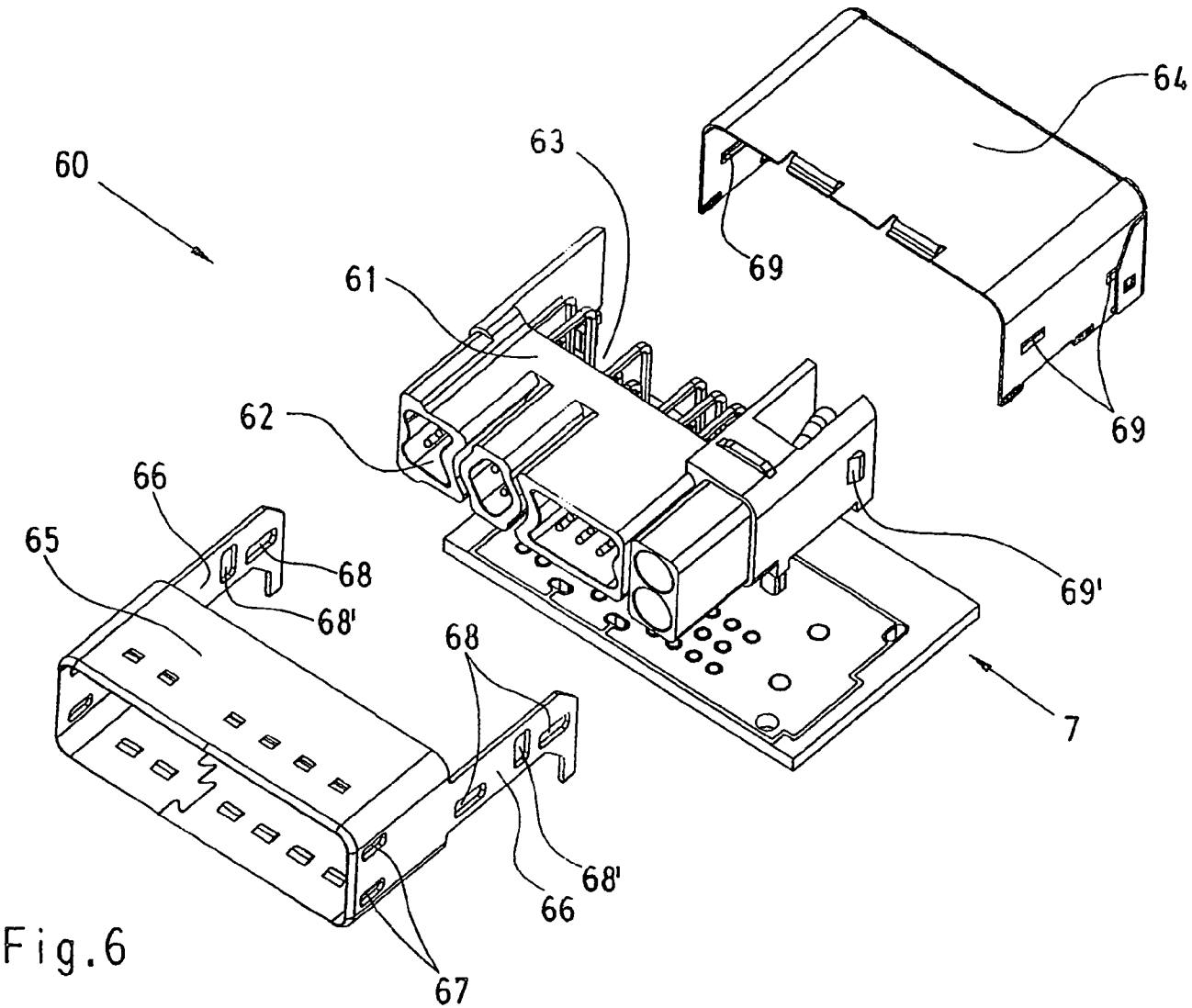
FIG. 6, an exploded view of a mating connector in the form of a PCB edge connector, and FIG. 7, the connector and the mating connector in the interconnected state.

FIG. 6 shows an exploded view of a mating connector 60 that is ready for installation on a PCB 7.

The mating connector 60 is composed of a metal sleeve 65, a connector insert 61 and a metal shroud 64.

The metal sleeve contains two mounting arms 66 that respectively have one angled end for realizing the ground connection with the PCB 7.

The mounting arms 66 also contain openings 68', into which tabs 69' engage that are integrally arranged on the insulating connector insert in order to hold the connector insert within the metal sleeve 65.

Clip elements 68 and 69 are also provided on the mounting arm 66 and the metal shroud 64 in order to clip the metal shroud on the metal sleeve.

Connector pins are arranged in polarizing structures 62 provided on the front side of the embodiment shown, namely in accordance with the female contacts 53 in the connector insert 50 of the connector 1.

In addition, the metal sleeve 65 respectively contains two openings 67 on its narrow sides. In the interconnected state of the connector 1, the above-described hooks 28 of the metal locking levers 27 engage into these openings and consequently form the locking mechanism of the plug connection.

FIG. 7 shows the connector 1 in the state in which it is connected to a mating connector 60. In this case, the sleeve 40 is illustrated in a partially sectioned fashion in order to elucidate how the hooks 28 engage into the openings 67 of the mating connector 60 in order to interlock the connector and the mating connector.

The installation of the mating connector on the PCB 7 is also shown, wherein the metal shroud 64 was omitted in order to better illustrate the connecting region 63.

The described mating connector for a PCB may also be realized in the form of a mating connector for a cable connection, wherein the same locking mechanism is used in this case.

The invention claimed is:

1. A locking device for a separable plug connection, particularly for rectangular connectors that are composed of a shielding metal housing, a connector insert and an insulating sleeve that encompasses the metal housing, as well as a correspondingly designed mating connector, wherein the metal housing is divided into a housing base and a cover part, the cover part contains two metal locking levers with respective hooks arranged thereon, and the encompassing insulating sleeve contains slots in its lateral surfaces within the housing interior with a sloped tab with a sliding surface respectively arranged on one or more of the lateral surfaces of the sleeve, whereby the metal locking levers of the cover part slide along the sliding surface of the sloped tab for connecting and disconnecting said mating connector.

2. The locking device according to claim 1, wherein the metal locking levers are integrally arranged on the lateral surfaces of the cover part and point in the connecting direction.

3. The locking device according to claim 1, wherein the cover part contains a stopping device for the sleeve.

4. The locking device according to claim 1, wherein the sleeve is captively held on the metal housing, in a displaceable fashion.

5. The locking device according to claim 1, wherein the slots in the lateral surfaces in the interior of the sleeve are angled outward referred to the axis of displacement in the connecting direction.

6. The locking device according to claim 1, wherein the connector insert is held in the metal housing with the aid of clip elements.

7. The locking device according to claim 1, wherein the hooks of the metal locking levers engage into openings in the metal sleeve of the mating connector.

8. The locking device according to claim 1, wherein the mating connector contains a metal sleeve that is arranged on the front side and provided with the openings.

9. The locking device according to claim 1, wherein the housing base and the cover part are connected with the aid of clip elements.

10. The locking device according to claim 1, wherein tabs are provided on the rear side of the metal housing, wherein a crimp ring can be slipped on said tabs.

11. The locking device according to claim 1, further comprising an end cap held on the metal housing by an adhesive.

12. The locking device according to claim 1, wherein the ends of the metal locking levers are provided with hooks that point to the metal housing.

13. The locking device according to claim 12, wherein the cover part contains a stopping device for the sleeve.

14. The locking device according to claim 13, wherein the sleeve is captively held on the metal housing, in a displaceable fashion.

15. The locking device according to claim 13, wherein the slots in the lateral surfaces in the interior of the sleeve are angled outward referred to the axis of displacement in the connecting direction.

16. The locking device according to claim 13, wherein the connector insert is held in the metal housing with the aid of clip elements.

17. The locking device according to claim 13, wherein the hooks of the metal locking levers engage into openings in the metal sleeve of the mating connector.

18. The locking device according to claim 13, wherein the mating connector contains a metal sleeve that is arranged on the front side and provided with the openings.

19. The locking device according to claim 13, wherein the housing base and the cover part are connected with the aid of clip elements.

20. The locking device according to claim 13, wherein tabs are provided on the rear side of the metal housing, wherein a crimp ring can be slipped on said tabs.

21. The locking device according to claim 13, further comprising an end cap held on the metal housing by an adhesive.

* * * * *

UNITED STATES PATENT AND TRADEMARK OFFICE

CERTIFICATE OF CORRECTION

PATENT NO. : 7,081,002 B2
APPLICATION NO. : 11/215287
DATED : July 25, 2006
INVENTOR(S) : De Vanssay et al.

It is certified that error appears in the above-identified patent and that said Letters Patent is hereby corrected as shown below:

Title page, item [30], foreign application priority data:

"10 2004 259" should be --10 2004 046 259.3--.

Signed and Sealed this

Tenth Day of February, 2009

John Doll

JOHN DOLL
*Acting Director of the United States Patent and Trademark Office*